US010420395B2

(12) United States Patent
Ooki

(10) Patent No.: US 10,420,395 B2
(45) Date of Patent: Sep. 24, 2019

(54) LOOSENING PREVENTION LACE

(71) Applicant: SHINDO CO., LTD., Awara, Fukui (JP)

(72) Inventor: Takashi Ooki, Awara (JP)

(73) Assignee: SHINDO CO., LTD., Awara (JP)

( * ) Notice: Subject to any disclaimer, the term of this patent is extended or adjusted under 35 U.S.C. 154(b) by 148 days.

(21) Appl. No.: 15/537,284

(22) PCT Filed: Nov. 20, 2015

(86) PCT No.: PCT/JP2015/005801
§ 371 (c)(1),
(2) Date: Jun. 16, 2017

(87) PCT Pub. No.: WO2016/110889
PCT Pub. Date: Jul. 14, 2016

(65) Prior Publication Data

US 2017/0340066 A1 Nov. 30, 2017

(30) Foreign Application Priority Data

Nov. 20, 2015 (JP) ..... 2015-002694

(51) Int. Cl.
*A43C 1/04* (2006.01)
*D04C 1/06* (2006.01)
(Continued)

(52) U.S. Cl.
CPC ..... *A43C 1/04* (2013.01); *A43C 9/00* (2013.01); *D03D 1/00* (2013.01); *D03D 1/0035* (2013.01);
(Continued)

(58) Field of Classification Search
CPC ..... A43C 1/04; A43C 9/00; A44B 99/005; D03D 15/08; D03D 15/0027;
(Continued)

(56) References Cited

U.S. PATENT DOCUMENTS

2004/0094024 A1* 5/2004 Kim ..... D04C 1/12 87/6
2006/0168785 A1* 8/2006 Kraft ..... A43C 1/02 24/715.3
(Continued)

FOREIGN PATENT DOCUMENTS

JP 2014-012912 A 1/2014
WO 80/01871 A1 9/1980
WO 00/61844 A1 10/2000

*Primary Examiner* — Robert Sandy
*Assistant Examiner* — Louis A Mercado
(74) *Attorney, Agent, or Firm* — Oliff PLC

(57) ABSTRACT

A loosening prevention lace which overcomes the problems where the lace is slackened or undone upon the lace being tied up through the eyelets for fastening the shoes, garment and as such and which brings unforeseen effect on design or appearance as well. The loosening prevention lace is provided by weaving one picot forming linear body or a plurality of picot forming linear bodies into a tubular woven fabric in a warp yarn direction thereof and protruding one picot forming linear body or a plurality of picot forming linear bodies from a surface of the tubular woven fabric with a certain interval over a longitudinal direction of the tubular fabric in a loop form.

9 Claims, 3 Drawing Sheets

(51) Int. Cl.

| | |
|---|---|
| ***D03D 3/02*** | (2006.01) |
| ***D03D 1/00*** | (2006.01) |
| ***A44B 99/00*** | (2010.01) |
| ***A43C 9/00*** | (2006.01) |
| ***D03D 15/00*** | (2006.01) |
| ***D03D 15/08*** | (2006.01) |

(52) U.S. Cl.
CPC ..... *D03D 3/02* (2013.01); *D03D 15/0027* (2013.01); *D03D 15/08* (2013.01); *D04C 1/06* (2013.01); *A44B 99/005* (2013.01); *D10B 2331/04* (2013.01)

(58) Field of Classification Search
CPC ..... D03D 1/0035; D03D 3/02; D03D 1/00; D04C 1/06; D10B 2331/04
See application file for complete search history.

(56) References Cited

U.S. PATENT DOCUMENTS

| | | | | |
|---|---|---|---|---|
| 2012/0144631 | A1* | 6/2012 | Stanev | A43C 1/02 24/715.3 |
| 2012/0233884 | A1* | 9/2012 | Greene | A43B 1/04 36/84 |
| 2013/0111782 | A1* | 5/2013 | Tsai | A43C 1/04 36/50.1 |
| 2013/0219750 | A1* | 8/2013 | Dojan | A43B 23/0265 36/87 |
| 2013/0269210 | A1* | 10/2013 | Woods | A43C 9/00 36/50.1 |
| 2014/0196316 | A1* | 7/2014 | Follet | A43B 23/0245 36/84 |
| 2015/0128643 | A1* | 5/2015 | King | D04C 1/12 63/1.12 |
| 2017/0295887 | A1* | 10/2017 | Torres | A43C 1/02 |

* cited by examiner

LOOSENING PREVENTION LACE

TECHNICAL FIELD

The present invention relates to a loosening prevention lace, especially pertaining to a loosening prevention lace which is used for a pair of shoes and garment fastened therewith through eyelets.

BACKGROUND ART

The braided cords in which a plurality of threads are interlaced with one another are provided with an unique design and flexibility, so that they are applied for various articles, among which a shoe lace is representatively exemplified. Functionally speaking, such shoe lace must be easy to be tied up and hard to be loosened besides its design, in which there have been a lot of proposals in response to the demand for its functionality of being hard to be loosened improving especially in terms of a pair of athletic shoes and as such.

In Document 1, such a technique is disclosed as hooks being provided on one side of a strip of material and loops being provided on the other side thereof so as to bring about fastening effect with which the knots become hard to be loosened, in which it is for sure that the knots once tied up together through the engagement of the hooks and loops turn out to be hard to be loosened whereas the problem lies in that the hooks and loops are entangled with one another when such strip of material is tied up for fastening.

On the other hand, in Document 2, such an elastic cord or lace body is disclosed as comprising an elastic core and a sheath; the portions where the constricting force of the sheath is strong and those where such force is weak are repeated; the diameter of the lace body hardly changes at the portions where such force is strong due to their limited stretchability, but such diameter enlarges at the portions where such force is weak due to the elastic core being contracted so as for the sheath to be slackened and the diameter of the lace body reduces when the elastic core is stretched.

In the state where any pulling force is not applied to the elastic cord disclosed in Document 2 or such cord is free from any force, the apparent diameter of such cord becomes large, but the braided lace comprising the sheath is too soft in its inflated state for such cord to function as a hitching cord to be stuck with the eyelets.

Further, in order to make the hitching effect enhanced, in Document 3 by way of one example, such a fastening cord is disclosed as being braided with a rubber material and a non-stretching material with the knotted center string forming a core, in which the firm protuberances of the center string bring the effect of preventing the cord from slipping at the eyelets, but the problem lies in that the cord becomes hard to get through the eyelets owing to the fact that the presence of such protuberances make the diameter of the cord hardly change even when the cord might be stretched.

CITATION LIST

Patent Literature

Document 1: Japanese Translation Publication No. SHO 56(1981)-500243

Document 2: Japanese Translation Publication No. 2002-541352

Document 3: Japanese Patent Unexamined Application Publication No. 2014-012912

SUMMARY OF INVENTION

Technical Problem

In view of the foregoing setbacks on the prior art, the present invention is to provide a loosening prevention lace which overcomes the problems where the lace is slackened or undone upon the lace being tied up through the eyelets for fastening the shoes, garment and as such and which brings unforeseen effect on design or appearance as well.

Solution to Problem

The means adopted herein for solving the foregoing problems are explained as follows with reference to the accompanying drawings.

The present invention is characterized in that a loosening prevention lace is constituted with one picot forming linear body or a plurality of such bodies being woven into the tubular woven fabric in the warp direction; and such body or bodies being protruded from the surface of such tubular woven fabric with a prescribed interval over the longitudinal direction of the woven fabric in a loop form. What is referred to as 'picot' herein denotes a frilled decoration in which a series of small loops continue on the fringe of the lace.

According to the present invention, the tubular woven fabric is constituted with the weave which incorporates elastic yarns in one part of the warp yarns and has stretchability in the warp direction; and a flexible lace material is adopted for the picot forming linear body or bodies, in which the loops formed by such linear body or bodies are changed into a slow sloped shape with a smaller curvature when such tubular woven fabric is stretched while they are changed into an acutely protruding shape with a larger curvature when the same is relaxed.

With such elastic yarns woven into the warp yarns of such tubular woven fabric as mentioned above, upon the lace being passed through the eyelets, the lace as a whole is elongated, thereby, the root-to-root interval of each loop being also stretched, so that the loops are changed into a slow sloped shape or the lace surface being changed into a smooth shape short of irregularities, which facilitates the lace to be passed through the eyelets, in which the stretchability of the tubular woven fabric causes the clamping force to be constantly exerted on the knots so that the lace becomes hard to be undone.

Further, as with the picot forming linear body or bodies, it is preferred that a lace material made from elastmer unitarily with the diameter of 1 to 3 mm be adopted for the same, concretely speaking, being preferred that an oval or round lace made from any one of natural or synthetic rubber, urethane rubber, silicone rubber and a polyurethane elastic yarn be adopted for the same.

On the other hand, a lace material with the apparent diameter of 1 to 3 mm in which a plurality of yarns collectively made into integration may be adopted for the picot forming linear body or bodies, concretely speaking, being preferred that such plurality of yarns be integrated through such yarns bundles aggregation process as selected from spool knitting, braiding and yarn twisting.

Moreover, as with the picot forming linear body or bodies, it is preferred that it be retained within the tubular woven fabric with partially intermingled with the weft yarns of the tubular woven fabric, in which especially when a plurality of picot forming linear bodies are woven into the tubular woven fabric, it is more preferable that such plurality of linear bodies be tied to one another at their non-protruding portions by the weft yarns of the tubular woven fabric.

Then, according to the present invention, it is preferred that the pitch between the loops protruding from the surface of the tubular woven fabric be from 5 mm to 50 mm; the root-to-root interval of each loop be from 2 mm to 10 mm; and the height of each loop be from 1 mm to 7 mm.

It is also preferred that a lace material made from a thermally fusible fibers material whose melting point is 120° C. or higher be adopted for the picot forming linear body or bodies and the linear body or bodies along with the weft and warp yarns of the tubular woven fabric be thermally fused to one another within the tubular woven fabric.

In addition, when a plurality of linear bodies are woven into the tubular woven fabric, it is preferred that such plurality of linear bodies woven into the tubular woven fabric be thermally fused to one another within the tubular woven fabric.

Furthermore, the lace tip section whose core is made of the picot forming linear body or bodies received within the tubular woven fabric is formed on both sides of the lace main body in which the picot forming linear body or bodies continuously protrude from the surface of the tubular woven fabric with the prescribed interval over the longitudinal direction thereof in a loop form, which lace tip section is formed thinner than the lace main body, thereby, the aglet working process being done without.

Upon forming the lace tip section, it may be formed far thinner by the elastic yarns partially woven into the warp yarns of the tubular woven fabric being disposed in parallel to the picot forming linear body or bodies within the tubular woven fabric in such a manner that they are not intermingled with the weft yarns.

Advantageous Effects

According to the present invention, on account that one picot forming linear body or a plurality of such bodies are woven into the tubular woven fabric in the warp direction thereof and such bodies protrude from the surface of the tubular woven fabric with a predetermined interval over the longitudinal direction thereof in a loop form, upon the fastening lace of garment, shoes and so forth being tied up through eyelets, the protruded loops act as stoppers at the eyelets so as to prevent the lace from being slackened.

Also at the knots, the protruded loops act as slip-off prevention means, so that once the lace is tied up, it becomes hard to be undone, with the result that it is useful when it is especially applied to athletic shoes frequently used under hard conditions.

Further, according to the present invention, the lace is constituted by a woven fabric with a bag-shaped structure, so that it allows loosening prevention laces with various design concepts such as textured or color patterns through e.g. Jacquard patterning to be provided.

The picot forming linear body protruding in a loop form being fused with any one of the weft or warp yarns intersected or intertwined therewith within the tubular woven fabric and any other picot forming linear body, it restrains the picot forming linear body from moving so as to keep the loops protruding from the surface of the tubular woven fabric intact.

Moreover, at the time of production, by alternately forming the lace main body segment L5 in which the picot forming linear body or bodies continuously protrude in a loop form from the surface of the tubular woven fabric with the predetermined interval over the longitudinal direction thereof and the thinly formed lace tip segment L6 whose core is made of the picot forming linear body or bodies; and cutting the middle of the lace tip segment L6 by thermal fusion, it allows the lace tip end to be thinly and rigidly finished with the aglet working step done without.

DESCRIPTION OF EMBODIMENTS

The best mode for carrying out the invention is explained in details with reference to the accompanying drawings as follows.

(Basic Constitution of Loosening Prevention Lace)

Figure 1:
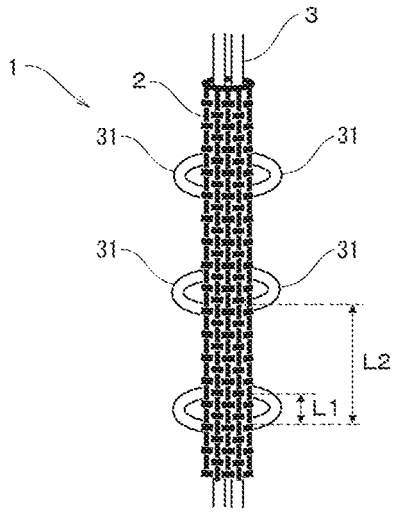
FIG. 1 is a schematic view showing the structure of the loosening prevention lace according to the present invention.

FIG. 1 shows one embodiment of the present invention, in which a loosening prevention lace, a tubular woven fabric with a bag-shaped structure, a picot forming linear body are represented with reference signs 1, 2 and 3 respectively. The loosening prevention lace 1 according to the present embodiment is constituted by two picot forming linear bodies 3 and 3 being woven into the tubular woven fabric 2 and protruding those picot forming linear bodies 3 from the surface of the tubular woven fabric 2 with the predetermined interval between the adjacent loops 31.

(Structure of Tubular Woven Fabric and Yarn Material in Use)

As for the tubular woven fabric 2, it is organized by alternately weaving the front side and the back side under double weave employing a shuttle weaving machine or is organized into hollow weave under double weave by engaging the selvage parts of both sides employing a needle loom, in which the width of the woven fabric ranges from 5 to 15 mm and the cross-sectional shape of the tubular woven fabric 2 after weaving is circular or oval. To note, such cross-sectional shape depends on e.g. the number of picot forming liner bodies 3 inserted within the tubular woven fabric 2.

The weaving yarns normally used for garment are adopted for the warp and weft yarns of the tubular woven fabric 2, which weaving yarns include such natural fibers as cottons and wools, such spun yarns and filament yarns as made from polyester, polyamide, acryl and their blended yarns and textured yarns, the fineness of such yarns ranging in the order of 50 to 400 dtex, and the weave of which woven fabric includes plain weave, twill weave, satin weave or Jacquard patterning with dyed yarns in use.

(Loops Formed by Picot Forming Linear Body)

On the other hand, the flexible picot forming linear body 3 is woven into the tubular woven fabric 2 apart from the warp yarns, in which long floats of the picot forming linear body 3 inside the tubular woven fabric 2 each having the predetermined length and short floats thereof directed to the surface of the tubular woven fabric 2 are repeated and the length of the floated picot forming linear body 3 by which the same is fed to the surface is enlarged, thereby, forming a loop 31.

Further, the picot forming linear body 3 is singly disposed or a plurality of such linear bodies are disposed within the tubular woven fabric, in which in the case where such plurality of linear bodies are disposed therein, it is preferred that they be disposed equi-distantly with regard to the circumferential direction of the tubular woven fabric 2 and the loops 31 derived from the picot forming linear bodies 3 be disposed at the same location (or at the same circumferential location) with regard to the longitudinal direction of the tubular woven fabric, thereby, the likelihood that any one of the loops 31 existing around the picot forming linear bodies 3 is hooked on the eyelets being enhanced, with the result that the loosening prevention effect is brought without fail.

Moreover, as for the picot forming linear body 3, it is preferred that the length of the floats directed to the surface of the tubular woven fabric 2 or the interval L1 between the roots of the loop 31 range from 2 to 10 mm. This is due to the fact that in the case where such interval is defined as being 2 mm or shorter, the loop 31 vertically erects on the surface of the tubular woven fabric so as to make the degree to which the loop 31 protrudes so excessive that the hooked resistance with which the lace is passed through the eyelets of garment, shoes and so on increases, with the result that the lace is hard to be passed there whereas in the case where such interval is defined as being 10 mm or longer, it makes the loop 31 arched in shape or the degree to which it protrudes is so small that the hooked resistance with which the lace is passed through the eyelets reduces, with the result that the intended loosening prevention effect is not brought.

Furthermore, as for the height of the loop 31, the hooked resistance with which the lace is passed through the eyelets and insertability thereof into them being taken into account, it is preferred that it range from 1 to 7 mm.

Then, such interval L1 can be adjusted based on the density with which the weft yarns are picked between the adjacent floats of the picot forming linear body 3 directed to the surface of the tubular woven fabric 2 and their number while the height of the loop 31 can be determined based on the degree to which the picot forming linear body 3 is fed to the surface of the tubular woven fabric and the degree to which the tubular woven fabric 2 is contracted after weaving.

Moreover, it is preferred that the pitch L2 between the adjacent loops protruding from the surface of the tubular woven fabric 2 be as short as possible in light of the fact that it facilitates the lace to be adjustively tied up, but it is preferred that such pitch L2 be within the range from 5 to 50 mm in conjunction with the afore-mentioned interval L1 of the loop 31. To note, the respective dimensions or the height and interval L1 of the loop 31 as well as the pitch L2 between the adjacent loops 31 are defined as those measured in the state where any external force is not applied to the loosening prevention lace 1.

(Elastic Yarns of Tubular Woven Fabric)

Figure 2:
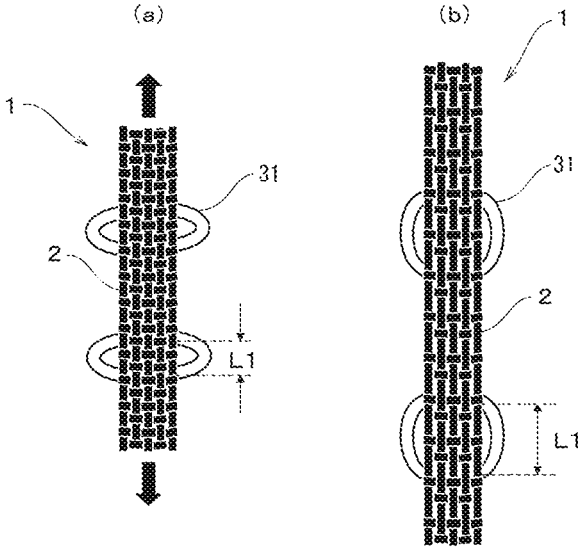
FIGS. 2 (*a*) and (*b*) are explanatory views to explain the functionality of the loosening prevention lace according to the present invention in two steps.

FIG. 2 shows a loosening prevention lace 1 in which elastic yarns are adopted for a part of the warp yarns of the tubular woven fabric 2 so that stretchability is provided to the same. FIG. 2 (*a*) shows the state where any pulling force is not applied to the longitudinal direction of the loosening prevention lace 1 while FIG. 2(*b*) shows the state where pulling force is applied to the arrow direction illustrated in FIG. 2(*a*). Then, when pulling force is applied thereto, as shown in FIG. 2(*b*), the interval L1 of the loop 31 is stretched, so that the loop 31 results in being shaped into a slow slope with a small curvature whereas when the lace is let loose, as shown in FIG. 2(*b*), such interval L1 is narrowed so that the loop 31 results in being shaped into an acute slope with a large curvature. In this way, by stretching the lace upon the same being passed through the eyelets, it reduces the hooked resistance induced by the loops while after the same is passed through the eyelets and stretching the same is suspended, the hooked resistance through the loops at the eyelets is resumed.

Further, providing strechability with the loosening prevention lace 1 makes the knots constantly tied up through elastic recovery so that the knots become hard to be undone.

As for how to adopt such elastic yarns for the warp yarns of the tubular woven fabric 2, the polyurethane elastic yarns as they are may be used, but for the purposes of protecting such elastic yarns and eliminating difference in color of dyed yarns it is preferred that the covering processing be performed on the polyurethane yarn with a regular yarn with the polyurethane yarn being used as a cored yarn, in which one polyurethane yarn as covered with a regular yarn is disposed in alignment against several warp yarns made of regular yarns in the weaving process and it is preferred that the mixing ratio of the polyurethane yarns to the loosening prevention lace 1 be 3 to 10 weight percent in content in view of the recovery behavior from the stretched state being optimized and the materials cost being minimized.

(Material for Picot Forming Linear Body)

As the loops 31 of the loosening prevention lace 1 are subjected to friction at the eyelets, it is preferred that an abrasion-resistant material be adopted for the picot forming linear body 3, in which aggregating a plurality of synthetic fiber yarns into integration with such yarns subjected to spool knitting, braiding or twisting process allows the picot forming linear body to be excellent in abrasion-resistance and its rigidity to be enhanced, so that the hooked resistance at the eyelets increases.

Further, it is preferred that the apparent diameter or thickness of the picot forming linear body 3 be from 1 to 3 mm, in which when such diameter is 1 mm or smaller, the linear body 3 results in being in short of rigidity so that the resistance through its loops at the eyelets and the knots reduces while when such diameter is 3 mm or larger, on the contrary, its rigidity becomes too high for the loops to be bent so that such problem occurs as the tubular woven fabric 2 serpentinely running as the result that it yields to the high rigidity of the picot forming linear body 3.

To note, the apparent diameter referred to herein denotes the diameter of the picot forming linear body 3 forming loops 31 protruding from the surface of the tubular woven fabric 2, denoting the major axis in terms of an oval cross-section however.

A lace material made from elastmer unitarily with the diameter of 1 to 3 mm is also adoptable for the picot forming linear body 3, for which, more concretely speaking, using an oval or round lace made from any one of natural rubber, synthetic rubber, urethane rubber, silicone rubber and a polyurethane elastic yarn brings more favorable effect on the slip prevention behavior of the lace and in which it is preferred that the hardness of such rubbers be 20 to 70. To note, such hardness is in compliance with JIS6253, in which when it is 70 or higher, the picot forming linear body becomes hard to be bent, so that it makes it impossible to form loops 31 while when it is 20 or lower, the tensile strength and abrasion resistance thereof deteriorate, so that the resulting lace becomes poor at weavability and durability, in view of which it is preferred that such hardness be 20 to 70.

(Thermal Fusion of Picot Forming Linear Body)

By e.g. the core-sheath complex yarns whose core is made from a high-melting polymer and whose sheath is made from a low-melting polymer being adopted for the picot forming linear body and the respective yarns comprising the picot forming linear body being integrally adhered to one another through the melted low-melting polymer, the rigidity of the loops 31 of the picot forming linear body increases so that the hooked resistance at the eyelets is enhanced, thereby, allowing a much thinner picot forming linear body to be provided for use.

Moreover, by performing the thermal fusion step after the loosening prevention lace is woven in which the picot forming linear body 3 is in the state where its complex yarns are not rigidly adhered to one another with the fused low-melting polymer, it permits ideal loops 31 to be obtained without the tubular woven fabric 2 being put into disorder and further the picot forming linear body 3 to be thermally adhered to the tubular woven fabric so that it prevents the loops 31 subjected to external force from being shoved into the tubular woven fabric 2.

As with the afore-mentioned core-sheath complex yarns, the sheath of which is made from a low-melting polymer whose melting point is in the order of 180 degrees Centigrade or lower, preferably, by incorporating 5 to 15 weight percent of the polyester complex yarns, to which the present invention is not limited however, to the picot forming linear body 3, it facilitates the respective yarns comprising the picot forming linear body to be securely adhered to one another.

By adopting a thermally fusible polymer for the picot forming linear body 3 and subjecting the picot forming linear body to heat treatment under the temperature higher than the softening point of such polymer which is the melting temperature thereof, it allows such linear body to be thermally fused to any one of the weft yarns and the warp yarns with which such linear body intersects or intertwines, which securely prevents the phenomenon in which the loops 31 subjected to external force are shoved into the tubular woven fabric 2 from occurring. In addition, when a plurality of picot forming linear bodies are woven into the tubular woven fabric 2, it is preferred that such plurality of picot forming linear bodies woven into the tubular woven fabric be thermally fused to one another therein.

It is preferred that a polymer whose melting point is 120 degrees Centigrade or higher, by way of one example, be adopted for such thermally fusible polymer, in which it is more preferable that a thermally adhesive urethane elastic yarn whose melting point ranges from 165 to 200 degrees Centigrade be adopted for the same due to the reasons that the temperature under which heat treatment is performed is comparatively low and such treatment is carried out with ease as well as stretchability is imparted to the picot forming linear body.

(Tip Section of Loosening Prevention Lace)

Figure 3:
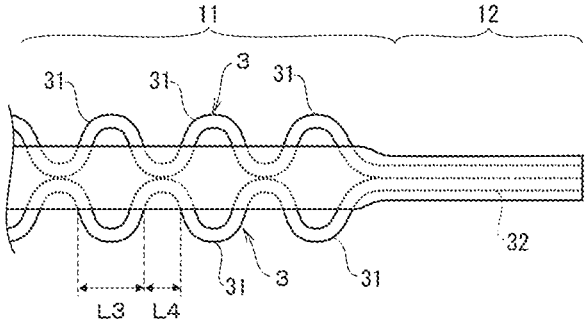
FIG. 3 is an explanatory view to show the shape and inner structure of the loosening prevention lace according to the present invention.

As shown in FIG. 3, on both sides of the lace main body section 11 (where the picot forming liner body 3 continuously protrudes from the surface of the tubular woven fabric 2 with the prescribed interval over the longitudinal direction thereof in a loop form), the lace tip section 12 with a core 32 which corresponds to the picot forming linear body 3 within the tubular woven fabric 2 is formed thinner than the lace main body section 11, thereby, allowing the aglet working process to be omitted.

(Weaving Structure of Loosening Prevention Lace)

(1) Portion where Loops Protrude

Figure 4:
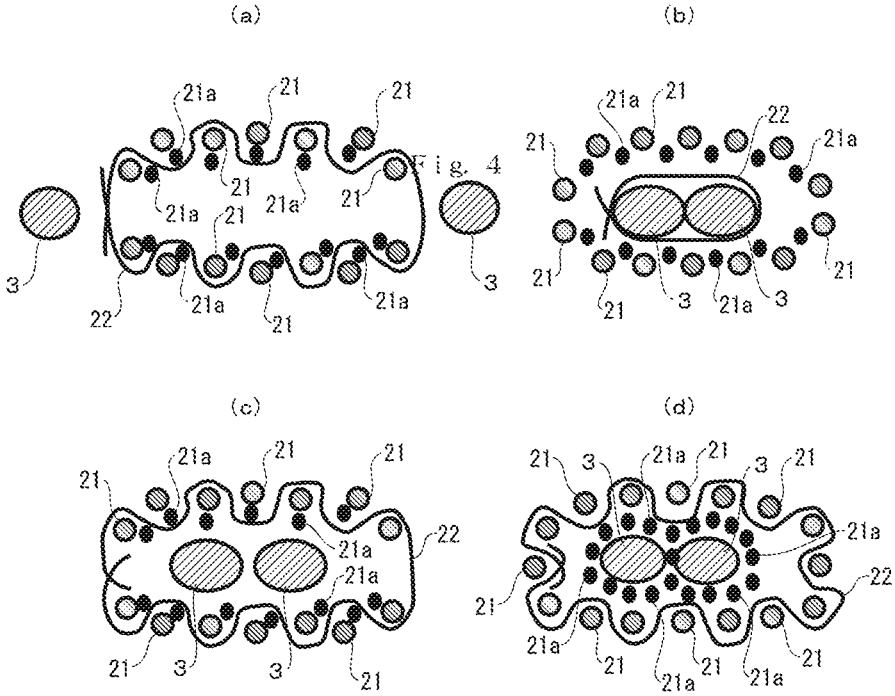
FIGS. 4 (*a*) and (*b*) are schematic cross-sectional views of the loosening prevention lace according to the present invention showing its woven structure.

Then, the weaving structures of the respective portions of the loosening prevention lace 1 are explained as follows. As for the portion L3 (see FIG. 3) where the loop 31 protrudes, as shown in FIG. 4(*a*), the tubular woven fabric 2 is organized into hollow weave with warp yarns 21 and weft yarns 22 and the loop 31 is formed with the portion of the picot forming linear body corresponding to such loop floated long. Further, the weft yarns 22 of the tubular woven fabric 2 are spirally interwoven such that they intertwine with the elastic yarns 21*a* and the other warp yarns 21.

(2) Portion where Loops do not Protrude

As for the portion L4 (see FIG. 3) where the loop 31 is not formed, as shown in FIGS. 4(*b*) and (*c*), the picot forming linear body 3 acts as the core of the lace so that it is hidden within the tubular woven fabric 2. Further, at this portion L4, as shown in FIG. 4(*b*), the picot forming linear body 3 is partially intertwined with the weft yarns so that it is retained within the tubular woven fabric 2. Especially when a plurality of picot forming linear bodies are interwoven into the tubular woven fabric 2, it is preferred that such plurality of picot forming linear bodies be tied to each other with the weft yarns within the tubular woven fabric, thereby, preventing the phenomenon in which the picot forming linear bodies are frictionally displaced so that the shape of the loop 31 is ruined from occurring.

Further, by narrowing the width with which the weft yarns intertwine with the picot forming linear bodies and increasing the number of picks at the portion where those bodies are tied with partially intertwined with the weft yarns, it more effectively prevents such bodies from being displaced.

(3) Lace Tip Section

As with the lace tip section 12 (see FIG. 3) of the loosening prevention lace 1, as shown in FIG. 4(*d*), by disposing within the tubular woven fabric 2 the elastic yarns 21*a* which are woven into the warp yarns and constitute a part of the warp yarns in parallel to the picot forming linear bodies 3 such that they do not intermingle with the weft yarns 22, it allows the tip section 12 to be formed much thinner.

(How to Produce Loosening Prevention Lace)

Figure 5:
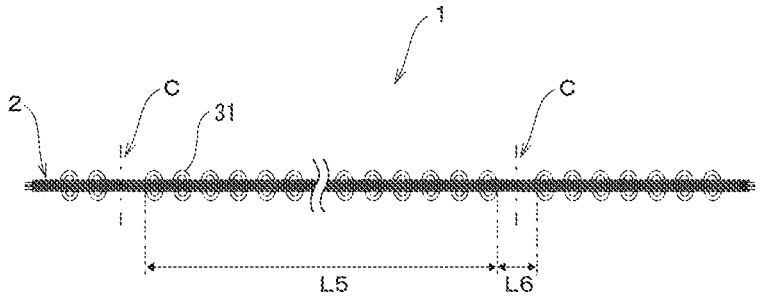
FIG. 5 is a schematic view to explain how to produce the loosening prevention lace according to the present invention.

Then, how to produce the loosening prevention lace 1 is explained as follows. Upon producing the same, as shown in FIG. 5, the lace main body segment L5 in which the loops 31 continuously protrude with the prescribed interval over the longitudinal direction of the tubular woven fabric 2 and the lace tip segment L6 in which there is no loop and the rigidity of which is higher than the main body segment L5 are alternatively formed. Especially, it is preferred that the length of the lace tip segment L6 be from 10 to 80 mm while the length of the lace main body segment L5 be selected where appropriate according to the intended use, which is normally within the range from 0.4 to 3 m, for instance, in the case of a shoe lace.

Moreover, as for the lace tip segment L6, the yarns whose thermal contraction is high are adopted for the weft yarns of the tubular woven fabric 2, in which subjecting the tip segment L6 to heat treatment under the temperature equal to or higher than the melting point of the thermally fusible yarns after weaving the lace causes the diameter of the tubular woven fabric 2 to be shrunken and the picot forming linear bodies 3 to be thermally fused at the same time so as to be cured. Just cutting the middle portion C (cut portion, see FIG. 5) of the cured tip segment L6 with a heat cutter and so on suffices to prevent the cut end of the lace from being undone and realizes the improved insertability of the lace through the eyelets and as such, which dispenses with the aglet working process.

In the case where there is an ample interval between the adjacent loops 31 or where there is a wide pitch between one loop to another in succession, it does not require that the lace tip segment L6 in which any loop does not protrude be provided in particular, but usually the interval between the adjacent loops 31 is small so that it is preferred that such lace tip section be provided during the weaving stage.

First Example

In FIG. 1, a loosening prevention lace according to the present example is shown with two loops provided with the prescribed interval between them in the symmetrical positions on the outer circumference of the tubular woven fabric, which lace is obtained by means of a needle loom by adopting a rubber cord whose diameter is 1.5 mm for the picot forming linear body 3 with the pitch between the adjacent loops, the root-to-root interval of each loop and the height of each loop defined as 7 mm, 2 mm and 1.5 mm respectively under the weaving and heat treatment conditions shown in Table 1.

TABLE 1

| | | |
|---|---|---|
| Type of Yarn | Warp | Wooly Nylon 56dtex/2 (Two Ply Yarn) |
| | | Polyurethane 560dtex |
| | Weft | Wooly Nylon 110dtex/2 (Two Ply Yarn) |
| Weave Density | Warp | 188 yarns/cm |
| | Weft | 30 yarns/cm |
| Weave Width | | 5 mm |
| Type of Weaving | | Hollow Weave |
| Heat Treatment | | 110° C. × 157 m/min. (air-conditioned) |

Second Example

Under the same weaving and heat treatment conditions shown in Table 1 according to the first example, a loosening prevention lace according to the present example is obtained by adopting a rubber cord whose diameter is 2.0 mm for the picot forming linear body 3 with the pitch between the adjacent loops, the root-to-root interval of each loop and the height of each loop defined as 7 mm, 3 mm and 2.5 mm respectively.

Third Example

Under the same weaving and heat treatment conditions shown in Table 1 according to the first example, a loosening prevention lace according to the present example is obtained by adopting a cord whose diameter is 2.0 mm and which is made by spool knitting for the picot forming linear body 3 with the pitch between the adjacent loops, the root-to-root interval of each loop and the height of each loop defined as 6 mm, 2 mm and 2.5 mm respectively.

Fourth Example

In FIG. 1, a loosening prevention lace according to the present example is shown with two loops provided with the prescribed interval between them in the symmetrical positions on the outer circumference of the tubular woven fabric, which lace is obtained by means of a needle loom by adopting a thermally fusible fibers material whose diameter is 1.0 mm for the picot forming linear body 3 with the pitch between the adjacent loops, the root-to-root interval of each loop and the height of each loop defined as 6 mm, 2 mm and 2 mm respectively under the weaving and heat treatment conditions shown in Table 2. It is confirmed that the thermally fusible fibers are firmly fused to one another under heat treatment.

TABLE 2

| | | |
|---|---|---|
| Type of Yarn | Warp | Polyester 56dtex/2 (Two Ply Yarn) |
| | | Polyurethane 560dtex |
| | Weft | Polyester 110dtex/2 (Two Ply Yarn) |
| Weave Density | Warp | 188 yarns/cm |
| | Weft | 36.2 yarns/cm |
| Weave Width | | 5 mm |
| Type of Weaving | | Hollow Weave |
| Heat Treatment | | 170° C. × 10.3 m/min. (air-conditioned) |

Fifth Example

In FIG. 1, a loosening prevention lace according to the present example is shown with two loops provided with the prescribed interval between them in the symmetrical positions on the outer circumference of the tubular woven fabric, which lace is obtained by means of a needle loom by adopting a thermally fusible fibers material whose diameter is 1.5 mm for the picot forming linear body 3 with the pitch between the adjacent loops, the root-to-root interval of each loop and the height of each loop defined as 9 mm, 1 mm and 2 mm respectively under the weaving and heat treatment conditions shown in Table 3. It is confirmed that the thermally fusible fibers are firmly fused to one another under heat treatment.

TABLE 3

| | | |
|---|---|---|
| Type of Yarn | Warp | Polyester 56dtex/2 (Two Ply Yarn) |
| | | Polyurethane 840dtex |
| | Weft | Polyester 110dtex/2 (Two Ply Yarn) |
| Weave Density | Warp | 156.6 yarns/cm |
| | Weft | 41.6 yarns/cm |
| Weave Width | | 6 mm |
| Type of Weaving | | Hollow Weave |
| Heat Treatment | | 170° C. × 10.3 m/min. (air-conditioned) |

(Verification Test)

The elongation rate and the change of the loop height upon the respective loosening prevention laces obtained according to the above first to fifth examples being elongated under the pulling force of 14.7 N are shown in the following table 4. It is confirmed through the verification test shown in Table 4 that elongating the loosening prevention lace according to the present invention upon the same being passed through the eyelets makes the curvatures of the loops smaller so as to reduce the hooked resistance at the eyelets so that it gets them through with ease whereas after the same being passed through the eyelets their original curvatures are recovered so that the hooked resistance at the eyelets increases, thereby the intended loosening prevention effect being brought, and also at the knots of the lace the loops exert resistance against the lace being undone.

TABLE 4

| Test Items | Elongation Rate (%) | Height of Loop (mm) Before Elongation | Height of Loop (mm) After Elongation |
|---|---|---|---|
| First Example | 62 | 1.5 | 1 |
| Second Example | 55 | 2.5 | 1.5 |
| Third Example | 60 | 2.5 | 2 |
| Fourth Example | 75 | 2 | 1.5 |
| Fifth Example | 74 | 2 | 1.5 |

REFERENCE SIGNS LIST

1 Loosening Prevention Lace
11 Lace Main Body Section
12 Lace Tip Section
2 Tubular Woven Fabric
21 Warp Yarn
21*a* Elastic Yarn
22 Weft Yarn
3 Picot Forming Linear Body
31 Loop
32 Core
C Cut Portion
L1 Root-to-root interval
L2 Pitch
L3 Portion where Loop Protrudes
L4 Portion where Loop does not Protrude
L5 Lace Main Body Segment
L6 Lace Tip Segment

The invention claimed is:

1. A loosening prevention lace comprising:

a plurality of picot forming linear bodies; and a tubular woven fabric having the plurality of picot forming linear bodies woven into the tubular woven fabric in a warp yarn direction of the tubular woven fabric, the plurality picot forming linear bodies protruding from a surface of the tubular woven fabric at a predetermined interval over a longitudinal direction of the tubular woven fabric in loops form, the plurality of picot forming linear bodies being tied with one another with weft yarns within the tubular woven fabric at portions of the loosening prevention lace where any loop does not protrude from the surface of the tubular woven fabric.

2. The loosening prevention lace according to claim 1, wherein:

the tubular woven fabric includes a weave in which elastic yarns are incorporated in a part of warp yarns and which has stretchability in the warp yarn direction;

the plurality of picot forming linear bodies are a flexible lace or yarn material that is adopted for the plurality of picot forming linear bodies; and the loops formed by the plurality of picot forming linear bodies, change into a slow sloped shape with a smaller curvature upon the tubular woven fabric being elongated, as compared to changing into an acute sloped shape with a larger curvature upon the tubular woven fabric being relaxed.

3. The loosening prevention lace according to claim 1, wherein the plurality of picot forming linear bodies is formed of a lace material made from elastomer unitarily with a diameter of 1 to 3 mm.

4. The loosening prevention lace according to claim 1, wherein the plurality of picot forming linear bodies is formed of a lace material with an apparent diameter of 1 to 3 mm in which a plurality of yarns are aggregated into integration.

5. The loosening prevention lace according to claim 1, wherein:

a pitch between adjacent loops protruding from the surface of the tubular woven fabric ranges from 5 to 50 mm;

a root-to-root interval of each loop ranges from 2 to 10 mm; and a height of each loop ranges from 1 to 7 mm.

6. The loosening prevention lace according to claim 1, wherein the plurality of picot forming linear bodies is formed of a lace material which is made from a thermally fusible fibers material having a melting point of 120° C. or higher, and the plurality of picot forming linear bodies are thermally fused to warp yarns and the weft yarns of the tubular woven fabric within the tubular woven fabric.

7. The loosening prevention lace according to claim 6, wherein the plurality of picot forming linear bodies woven into the tubular woven fabric are thermally fused to one another within the tubular woven fabric.

8. The loosening prevention lace according to claim 1, wherein on both sides of a lace main body section in which the plurality of picot forming linear bodies continuously protrude from the surface of the tubular woven fabric at the predetermined interval over the longitudinal direction of the tubular woven fabric in the loops form, a lace tip section having a core which corresponds to the plurality of picot forming linear bodies within the tubular woven fabric is formed thinner than the lace main body section.

9. The loosening prevention lace according to claim 8, wherein at the lace tip section, elastic yarns woven into warp yarns so as to form a part of the warp yarns are disposed in parallel to the plurality of picot forming linear bodies within the tubular woven fabric in such a state that the elastic yarns do not intermingle with the weft yarns.

* * * * *